United States Patent [19]

Oka et al.

[11] 4,390,685

[45] Jun. 28, 1983

[54] POLYESTER FIBER AND PROCESS FOR PRODUCING SAME

[75] Inventors: Ken-ichiro Oka; Masatoshi Mineo, both of Mishima; Terumichi Ono, Tokyo, all of Japan

[73] Assignee: Toray Industries, Inc., Tokyo, Japan

[21] Appl. No.: 276,058

[22] Filed: Jun. 22, 1981

[30] Foreign Application Priority Data

Jun. 27, 1980 [JP] Japan ..... 55-86575
Jun. 27, 1980 [JP] Japan ..... 55-86576

[51] Int. Cl.[3] ..... C08G 63/02

[52] U.S. Cl. ..... 528/272; 528/309; 528/308.1; 264/210.8

[58] Field of Search ..... 528/272, 309

[56] References Cited

U.S. PATENT DOCUMENTS 3,772,872 11/1973 Piazza et al. ..... 264/210.8
4,134,882 1/1979 Frankfort et al. ..... 528/309

*Primary Examiner*—Lucille M. Phynes
*Attorney, Agent, or Firm*—Austin R. Miller

[57] ABSTRACT

A polyester fiber highly suitable for a raw yarn for a woven or knitted fabric, having a residual elongation of not higher than 60%, a Young's modulus of 60 to 100 g/d, a boiling water shrinkage of 4 to 10% and a dry heat shrinkage of 5 to 12%, the peak stress temperature in a dry heat shrinkage stress curve of said fiber being lower than 100° C. The fiber can be produced by a process comprising melt spinning a thermoplastic polyester through a spinneret into a filament and taking up the filament after solidifying the spun filamentary polymer, characterized in that the whole process from spinning through take-up is carried out without heating the filament, the filament is subjected to stretch treatment at a stretch ratio of not more than 20% after the solidification of the filament but before take-up, and take-up is carried out at a take-up speed of not less than 5,000 m/min.

4 Claims, 4 Drawing Figures

POLYESTER FIBER AND PROCESS FOR PRODUCING SAME

The invention relates to an improvement in or relating to polyester fibers. More particularly, the invention relates to a polyester fiber which has uniform dyeability, shows very high heat set efficiency at subsequent processing steps and affords a desirable hand in resulting woven or knitted fabric, and to a process for producing such a polyester fiber.

Polyester fibers have been manufactured on an industrial scale over many years, and since polyester fibers are excellent over other synthetic fibers in physical properties, they have been widely used in various fields as is well known.

As raw yarns for woven or knitted fabrics, there are ordinarily used drawn yarns obtained by subjecting undrawn yarns taken up at a spinning speed of 1,000 to 1,500 m/min to drawing and, optionally, subjecting them to heat treatment. However, many steps are required for obtaining drawn yarns by this method and the manufacturing cost is increased. Further, since various external disturbances are synergistically imposed on the yarns at the spinning, drawing and heat-treating steps, many problems must be solved in order to obtain uniform raw yarns suitable for the manufacture of woven or knitted fabrics.

Furthermore, since raw yarns obtained according to the above methods retain high physical properties inherent in polyesters, such as high Young's modulus and high tenacity, woven or knitted fabrics prepared from these raw yarns have too hard a hand and they feel coarse and stiff, and furthermore, they retain the waxy hand inherent in synthetic fibers. Accordingly, these polyester raw yarns are defective in that the feel and touch are widely different from those of natural fibers.

As other raw yarns for woven or knitted fabrics, which have been developed mainly for reduction of the manufacturing cost, there are known drawn yarn-like products prepared only through the spinning step. As the process for preparation of raw yarns of this type, there have been proposed various processes, for example, (I) a direct spin-draw process in which a spun yarn is drawn subsequently to the spinning step before performing the winding operation, (II) a process in which the spinning speed is increased to several thousand meters per minute to obtain a yarn having a structure similar to that of a drawn yarn and (III) a process in which an extruded yarn is solidified and is then subjected to a high-temperature heat treatment to obtain a drawn yarn-like product.

In the direct spin-draw process (I), although a raw yarn having a structure similar to that of the conventional drawn yarns can be obtained, heat treatment at a high temperature is required because of the high speed at the drawing step, which necessitates providing a heating roller or a heating plate having high efficiency to the apparatus and the production of the yarn becomes expensive due to the increased equipment and energy costs.

Process (II) is specifically disclosed in the specifications of U.S. Pat. Nos. 2,604,667 and 4,134,882. However, in order to obtain a drawn yarn-like product, suitable for practical applications, according to this process, the winding speed should be increased to an extremely high level, such as 6000 to 8000 m/min. Since the coherency of the spun yarn is poor due to the high spinning speed, the air resistance and the influence of the concomitant current vary greatly between the individual component filaments causing yarn vibration and, thus, a large fluctuation in the yarn tension. Thus, the resulting yarns have defects in that they may have broken component filaments and yarn unevenness and they may dye unevenly. Further, since the shrinkage in boiling water of a yarn spun and taken up at such a high speed may be as low as 4%, the elasticity of the yarn is low and in this yarn the winding tension fluctuates greatly even with a slight change of the winding relax ratio, with the result that such defects as component filament breakage and yarn unevenness readily occur. Moreover, it is very difficult to conduct the operation stably in this process.

Process (III) was proposed in the past by Japanese Patent Publication No. 13156/60 and recently by Japanese Patent Application Laid-Open Specification No. 118030/77. In this process, since a solidified yarn travelling at a high speed must be subjected to a heat treatment at a considerably high temperature, problems such as fusion bonding and yarn breakage readily occur during the operation, especially when yarns are threaded on a heat treatment apparatus maintained at a high temperature. Moreover, even if this threading operation is conducted conveniently, since it is very difficult to uniformly heat-treat respective single filaments, heat treatment unevenness readily occurs and the inner structure of the yarn becomes uneven, with the result that dyeing unevenness and kink unevenness are apt to appear in the resulting woven or knitted fabric. Further, since a heat treatment apparatus of high efficiency is required, the production of the yarn is expensive due to the increased equipment and energy costs.

On the other hand, a process in which a spun and soldified yarn is subjected to fretting by a friction guide and the like so as to produce a tension gradient and is then taken up at a winding speed of 2,500 to 4,000 m/min is disclosed in Japanese Patent Application Laid-Open Specification No. 96521/76. In this process, a yarn similar to conventional drawn yarns can be produced without subjecting it to heat treatment. However, the difference between the individual components filaments is large because the tension gradient is produced by fretting and, thus, the structure of the yarn becomes uneven with the result that dyeing unevenness and kink unevenness are apt to appear in the resulting fabric. Furthermore, yarn breakage or component filament breakage may often occur due to the fretting force and the resulting yarn may have poor processability.

In view of the physical properties of raw yarns produced according to the above-mentioned known techniques, extensive research was carried out to develop raw yarns of polyester fibers which can provide a woven or knitted fabric having high heat-set efficiency at subsequent processing steps and a uniform and desirable hand, and for developing a process capable of producing such raw yarns stably and economically. The present invention is a result of this research.

A primary object of the present invention is to provide a raw yarn having a novel structure, which can be taken up in a stable and uniform package as a raw yarn for a woven or knitted fabric, which shows very good heat set efficiency at subsequent processing steps and is capable of producing a desirable feel and touch in the resulting woven or knitted fabric, and to provide a process for producing such a raw yarn.

Thus, the present invention provides a polyester fiber having a residual elongation of not higher than 60%, a Young's modulus of 60 to 100 g/d, a boiling water shrinkage of 4 to 10% and a dry heat shrinkage of 5 to 12%, the peak stress temperature in a dry heat shrinkage stress curve of said fiber being lower than 100° C. The polyester fiber according to the present invention preferably shows a specific diagonal four-point interference pattern in the small angle X-ray scattering pattern. Further, in the polyester fiber of the present invention, the difference, $\Delta\nu$, between the maximum half-band width and the minimum half-band width in the Raman spectra at 1730 $cm^{-1}$ scattered at radial individual points of the fiber cross-section by laser beam focussed on the points is preferably not more than 3 $cm^{-1}$.

The present invention will be described in detail below.

Polyester suitable for use in the present invention preferably contains not less than 80 mole %, more preferably 90 mole %, of ethylene terephthalate units. It may be a copolymer but the copolymer should preferably contain at least 80 mole %, more preferably at least 90 mole %, of ethylene terephthalate units.

In order for the fiber to have physical properties which permit efficient further processing, it is necessary that the residual elongation of the fiber should be lower than 60% and preferably higher than 30%. If the residual elongation is higher than 60%, the structure of the raw yarn is unstable and is remarkably changed with the lapse of time, and deformation is readily caused under application of a slight external force. Accordingly, such raw yarn cannot practically be used as a raw yarn for a woven or knitted fabric. The Young's modulus should be in the range of from 60 to 100 g/d and preferably in the range of from 70 to 90 g/d. In ordinary polyester fibers, the Young's modulus is about 120 g/d. If the Young's modulus is adjusted to the relatively low level described above, the coarse and stiff hand can be eliminated from the resulting woven or knitted fabric, and good bulkiness and softness can be imparted to the woven or knitted fabric. When the Young's modulus is lower than 60 g/d, the resulting woven or knitted fabric is too soft and has very low stiffness and the fabric is an undesirable paper-like product.

In the present invention, it is important that the boiling water shrinkage be controlled to 4 to 10% and preferably 5 to 8% and the dry heat shrinkage be controlled to 5 to 12% and preferably 6 to 10%. A raw yarn having a boiling water shrinkage lower than 4% or a dry heat shrinkage lower than 5% is defective in that the elasticity is very low, a great change in tension is caused by a slight change of the winding relax ratio or the like and the structure of the yarn is readily made uneven in the lengthwise direction of the yarn. In an extreme case, the yarn cannot be wound in a uniform or stable package and problems such as formation of fluff and component filament breakage occur, rendering the operation practically impossible. For example, even if a package is formed from such raw yarn, fluff and other defects are readily formed on the yarn by large tensile forces or squeezing forces applied to the yarn at various subsequent processing steps in the manufacture of a woven or knitted fabric. Occurrence of these problems can be prevented by controlling the shrinkage characteristics of the raw yarn within the above-mentioned ranges. When the boiling water shrinkage or dry heat shrinkage exceeds the upper limit, a woven or knitted fabric having the desired physical properties and hand cannot be prepared from the raw yarn, since tentering at the finishing step is difficult to carry out successfully or the resulting fabric is an undesirable paper-like product because the rate of shrinkage is too high.

The most characteristic feature of the fiber of the present invention as a raw yarn for a woven or knitted fabric is that although the fiber has the above-mentioned residual elongation, Young's modulus and shrinkage characteristics, the peak stress temperature in a dry heat shrinkage stress curve is lower than 100° C.

In the case where this peak stress temperature is lower than 100° C., the heat set efficiency can be markedly increased by various heat set treatments at subsequent processing steps for the manufacture of a woven or knitted fabric.

As will be apparent from the foregoing description, if all of the above requirements of the residual elongation, Young's modulus, shrinkage characteristics and peak stress temperature specified in the present invention are simultaneously satisfied, a polyester fiber can be wound in a stable and uniform package as a raw yarn for woven or knitted fabric, and this polyester fiber shows a very good heat setting properties at subsequent processing steps and a desirable feel and touch is imparted to a woven or knitted fabric prepared from this raw yarn.

The present invention will further be illustrated below with reference to the attached drawings, wherein.

Figure 1:
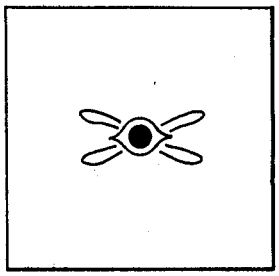
FIG. 1 shows a diagonal four-point interference pattern in the small angle X-ray scattering pattern of a preferred embodiment of the polyester fiber of the present invention.

The polyester fiber of the present invention preferably has a specific diagonal four-point interference pattern, in the small angle X-ray scattering pattern, as shown in FIG. 1. The small angle X-ray scattering pattern shown in FIG. 2 clearly differs from the pattern in FIG. 1 and is of a practically usable, conventional drawn polyester fiber obtained by taking up a spun yarn at a speed of 1,000 to 1,500 m/min and heat drawing the yarn.

It is supposed that the specific diagonal four-point interference pattern as shown in FIG. 1 represents the fact that the crystallization of the fiber does not proceed by the action of heat. That is, during the cooling of the as spun polymer, the crystallization of the polymer and thus the orientation may rapidly proceed, by the internal stress through the elongation during the spinning, at a temperature range affording high crystallization rate and, at the same time, the relaxation of orientation in the amorphous region may proceed. Therefore, the resulting fiber has an internal structure similar to that of a crystalline fiber affording desirable physical properties sufficient for practical use, while the fiber also has very excellent heat setting ability since the crystalline structure is not formed by heat crystallization.

Further, the polyester fiber according to the present invention preferably has a distribution of crystallinity in the radius direction controlled to a constant level. A means for precisely determining the distribution of crystallinity in the radius direction of a fiber is the measurement of the half-band width in the Raman spectrum at 1730 $cm^{-1}$ scattered at a point of a fiber cross-section by laser beam focussed on the point, as will be described in detail hereinafter. Thus, the polyester fiber of the present invention preferably has a difference, $\Delta\nu$, between the maximum half-band width and the minimum half-band width, in the Raman spectra at 1730 $cm^{-1}$ scattered at radial individual points of the fiber cross-section by laser beam focussed on the points, of not more than 3 $cm^{-1}$. If $\Delta\nu$ is more than 3 $cm^{-1}$, component filament breakage before or after the solidification may often occur during spinning, which makes a stable spinning operation difficult. More preferably, the difference between the maximum half-band width and the minimum half-band width in the Raman spectra at 1730 $cm^{-1}$ scattered when the laser beam is focussed on the central points of the individual filaments spun from the same spinneret plate is controlled to a level of not more than 5 $cm^{-1}$.

The polyester fiber of the present invention can be produced by a process comprising melt-spinning a thermoplastic polyester through a spinneret to form a filament and taking up the filament after solidifying the spun filamentary polymer, characterized in that the whole process from the spinning through the taking up is carried out without heating the filament. The filament is subjected to stretch treatment at a stretch ratio of not more than 20% after the solidification of the filament but before the taking up, and the taking up is carried out at a take-up speed of not less than 5,000 m/min.

One important feature of the process of the present invention is that the whole process from the spinning through the taking up is carried out without heating the filament, i.e. at ambient temperature. That is, the spun filament is not heated during the whole process from the spinning through the taking up, especially at the stretching step effected after the solidification of the spun polymer. Conventionally, the stretching is generally carried out concurrent to heat setting for the purpose of the improvement in the physical properties of the resulting fiber. However, in the present invention, the stretching treatment can be effectively carried out, without heating, by controlling the take-up speed to a level of not less than 5,000 m/min and the stretch ratio to a level of not more than 20%.

Stretching at a ratio of not more than 20% is important for the successful operation of the process and producing the desirable physical properties in the resulting fiber. By this stretching treatment, the coherency of the spun filaments is greatly improved and the concomitant current makes a constant flow, so that yarn vibration does not occur and, thus, the fluctuation in the yarn tension is largely decreased. Further, since the elasticity of the yarn is increased due to the increased boiling water shrinkage and dry heat shrinkage, fluctuations in the winding tension through changes in the winding relax ratio are decreased.

Preferably, the stretch ratio is in a range of 4 to 20%. Stretching at a ratio within this range can provide a highly desirable raw yarn for a woven or knitted fabric having no yarn unevenness and no dyeing unevenness. If stretching is carried out at a stretch ratio of more than 20%, the yarn shrinkage may be greater than 10% and a woven or knitted fabric of poor dimensional stability results. Further, the resulting fabric often has poor hand and appearance.

The stretch ratio referred to herein is defined by the following equation, $$\text{Stretch rátio (\%)} = \frac{S_2 - S_1}{S_1} \times 100$$

wherein $S_1$ respresents the yarn speed before stretching and $S_2$ represents the yarn speed after stretching.

In the process of the present invention, the stretched filament is taken up at a take-up speed of not less than 5,000 m/min. If the take-up speed is less than 5,000 m/min, the resulting fiber has poor physical properties because of insufficient crystallization and can not provide a practically usable raw yarn for woven or knitted fabric. In some cases, it may be difficult to stably carry out the stretch treatment without heating. More preferably, taking up is carried out at a speed of not less than 5,500 m/min.

It is possible to control the crystallinity distribution in the radius direction below a certain level by appropriately selecting the conditions for melting and cooling the polymer upon the melt spinning of the polymer. For example, the following conditions may advantageously be selected:

a. Feeding polymer chips of an intrinsic viscosity lower than that of chips for conventional filamentary yarns for clothing, preferably of an intrinsic viscosity of not higher than 0.63;
b. feeding polymer chips of a fairly high moisture regain, preferably of a moisture regain of not less than 0.005%;
c. effecting the spinning at a fairly high temperature, preferably a temperature of not lower than 300° C., and maintaining that temperature for a time prior to the molten polymer being spun from the spinneret, preferably a time of more than 15 minutes, and controlling the mean degree of polymerization of the molten polymer at a fairly low level;
d. employing a cooling air at a temperature as high as possible but below the glass transition temperature of the polymer and setting the starting point of cooling at a position as far as possible from the spinneret; and,
e. preventing the concomitant current from being made turbulent by the cooling air.

The crystallinity distribution in the radius direction also largely depends on the stretch treatment as above mentioned.

Figure 3:
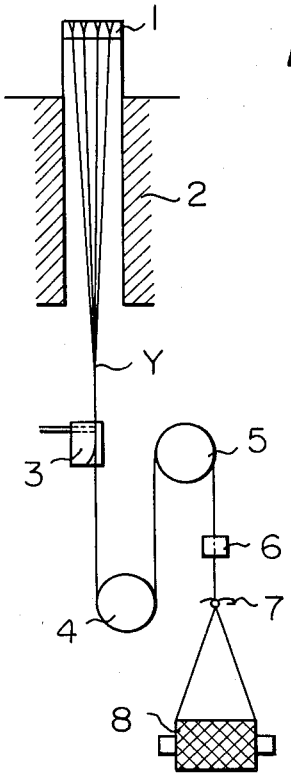
FIG. 3 shows a schematic view of an apparatus on which the process for producing the polyester fiber according to the invention can be advantageously carried out; and, FIG. 4 shows a pattern of a scattered Raman spectrum.

The process of the present invention will further be illustrated with reference to FIG. 3. Referring now to FIG. 3, a polyester yarn Y extruded from a spinneret 1 is solidified while it is passed through a cooling apparatus 2, and the yarn Y is oiled in an oiling agent-applying apparatus 3 and is then wound by a winding apparatus 8 while the yarn path and yarn speed are regulated by first and second goddet rolls 4 and 5. The peripheral speed of the second goddet roll 5 is adjusted to a level higher than the peripheral speed of the first goddet roll 4 to effect a stretch treatment between the first and second goddet rolls 4 and 5. The peripheral speeds of both the goddet rollers are indpendently adjusted so that a stretch ratio of up to 20% may be obtained. The winding speed of the winding apparatus is set at a level higher than 5,000 m/min. The peripheral speed of the second goddet roll 5 is substantially the same as the winding speed of the apparatus, though the peripheral speed of the second goddet roll 5 is changed to some extent according to the winding tension between the second goddet roll and the winding apparatus. From the viewpoint of the uniformity of the wound yarn, it is preferred that the winding tension be in the range of from 0.05 to 0.50 g/d.

An interlacing apparatus 6 for imparting entanglements to the yarn may be disposed between the second goddet roll and the winding apparatus according to need. In FIG. 3, reference numeral 7 represents a traverse fulcrum guide.

As the method for effecting the stretch treatment, there may be considered various methods, for example, a method in which a yarn is stretched stepwise by a plurality of pairs of rolls and a method in which the stretch treatment is conducted between the second goddet roll 5 and the winding apparatus 8 (in this case, the winding tension may be adjusted to a level higher than 0.50 g/d). In the present invention, any method can be adopted for the stretch treatment, as long as the yarn is subjected to a stretch treatment at a stretch ratio of not more than 20% after solidification of the spun polymer before it is wound on the winding apparatus. However, it is important that the yarn is not subjected to a fretting action during the stretching.

The polyester fiber according to the present invention may have a circular cross-section or a multi-lobal cross-section such as of tri-lobal, tetra-lobal or the like.

A raw yarn prepared as mentioned above can be wound stably into a beautiful package. The raw yarn has good operation adaptability and if this raw yarn is used for the manufacture of a woven or knitted fabric, it shows a very high heat set efficiency at subsequent processing steps. Occurrence of fluff or yarn breakages is reduced and a uniform woven or knitted fabric having an even dyeability and a good hand can be obtained. Furthermore, if a raw yarn having a residual elongation higher than 30% is subjected to a false twisting treatment, variations of the false twisting tension due to external disturbances are remarkably reduced and the raw yarn shows a very high heat set efficiency. Accordingly, this raw yarn is ideal as the raw yarn to be subjected to false twisting treatment.

Further, according to the present invention, a yarn of polyester fiber having excellent heat setting properties can be provided, and the equipment and energy costs can be largely reduced because heat treatment after spinning is unnecessary. Furthermore, the productivity of polyester yarns for woven or knitted fabrics is remarkably increased since the yarns can be produced at a speed of not less than 5,000 m/min.

In order to clarify the physical properties specified in the present invention, methods for measurement of these physical properties will now be described.

(1) Residual Elongation:

A stress-strain curve was obtained at a pulling speed of 100 m/min and a chart speed of 200 m/min with a sample length of 200 mm by using a Tensilon tensile tester manufactured and supplied by Toyo Baldwin Co. The elongation at which the yarn breaks is defined as the residual elongation.

(2) Young's Modulus (M):

A stress-strain curve is obtained at a pulling speed of 200 m/min and a chart speed of 1000 m/min with a sample length of 200 mm by using a Tensilon tensile tester manufactured and supplied by Toyo Baldwin Co., and the Young's modulus is calculated according to the following formula:

$$M\,(g/d) = \frac{A}{(B/L) \times D}$$

wherein A is an elongation at a point at which the stress-strain curve starts to curve so as to deviate from the straight line and B is the load at that point, L stands for the chart speed, and D stands for the filament denier.

(3) Boiling Water Shrinkage (ΔSw):

A sample yarn is wound 10 turns on a reeling machine having a peripheral length of 1 m, and a load of 0.1 g/d is applied and the original length $l_0$ is measured. Then, the sample yarn is treated in boiling water for 15 minutes and air-dried. Then, the sample length $l_1$ is measured under a load of 0.1 g/d. The boiling water shrinkage is calculated according to the following formula:

$$\Delta Sw = \frac{l_O - l_1}{l_O} \times 100(\%)$$

(4) Dry Heat Shrinkage (ΔSd):

A sample yarn is wound 10 turns on a reeling machine having a peripheral length of 1 m, and the original length $l_0$ is measured under a load of 0.1 g/d. Then, the sample yarn is treated for 5 minutes in an oven maintained at 200° C. Then, the sample length $l_1$ is measured under a load of 0.1 g/d and the dry heat shrinkage is calculated according to the following formula:

$$\Delta Sd = \frac{l_O - l_1}{l_O} \times 100(\%)$$

(5) Peak Stress Temperature in Dry Heat Shrinkage Stress Curve:

An initial load corresponding to 1/15 of the denier of the sample yarn is applied to the sample yarn in a thermal stress measurement device, Model KE-2 manufactured and supplied by kanebo Engineering Co., and the sample yarn having a length of 20 cm is looped so that the loop length is 10 cm. The temperature is elevated at a temperature-elevating rate of 150° C./min to obtain a dry heat shrinkage stress curve. A temperature providing a peak of the stress in this curve is defined as the stress peak temperature. Incidentally, a recorder, Model X-Y 3083 manufactured and supplied by Yokokawa Electric Co., is used for the measurement.

(6) Small Angle X-ray Scattering Pattern:

The pattern is obtained by small angle X-ray scattering photography. An X-ray generator, RU-3VX manufactured by Rigaku Denki Co., is used while applying 50 kV and 70 mA to the X-ray source provided with CuKα (Ni filter). The photograph is taken at an exposure time of 30 minutes under reduced pressure.

Figure 4:
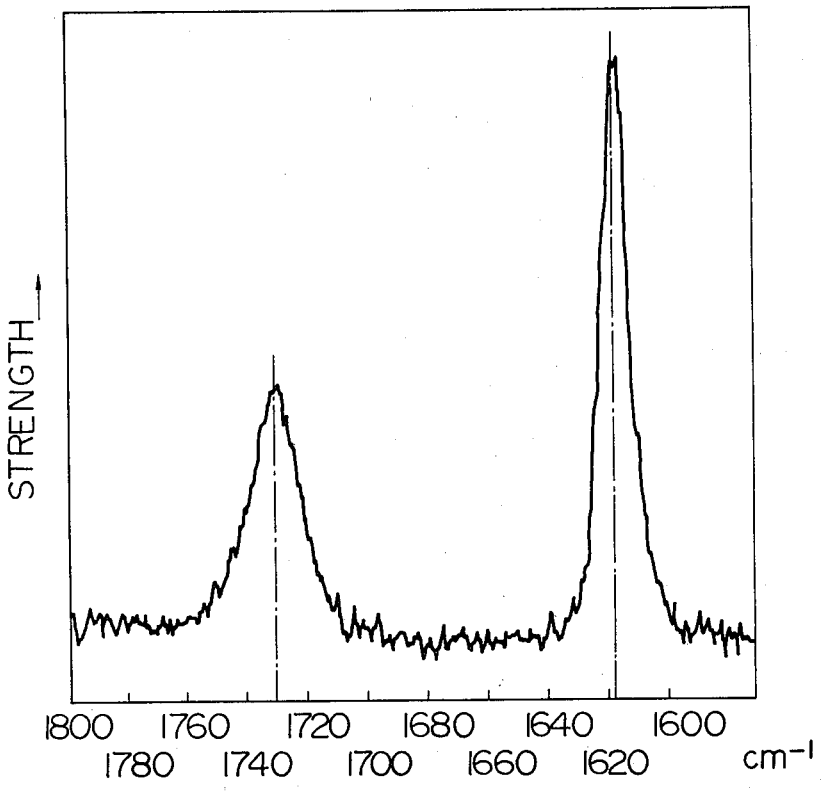

(7) Half-Band Width of Laser Raman Spectrum:

Measurement is carried out using a commercially available apparatus, Molecular Microprobe Optics Laser Examiner (MOLE) manufactured by Yvon-Jobin Co., by the following procedure:

(a) a filament is filled up by paraffin and cut to a thickness of about 10 μm in the direction perpendicular to the filament axis to obtain a section sample;

(b) some measurement points (generally 7 or 8 points) are determined in the radius direction of the section sample;

(c) An Ar-ion laser beam is focussed on one measurement point;
(d) the Raman spectrum scattered is recorded on a chart to form the Raman spectrum pattern at 1618 $cm^{-1}$ and 1730 $cm^{-1}$ as shown in FIG. 4;
(e) the half-band width of the spectrum at 1730 $cm^{-1}$ is read;
(f) the procedure in the above (c) to (e) is repeated regarding the other measurement points; and,
(g) the difference between the maximum and minimum values of the measured half-band width is represented by $\Delta\nu$.

The present invention will now be described in detail with reference to the following non-limitative Examples.

EXAMPLE 1

Raw yarns prepared according to various processes were tested under weaving conditions described below. The preparation process and physical properties of the raw yarns are shown in Table 1, and the results of the evaluation of hand of the obtained woven fabrics are shown in Table 2.

[Processes For Preparation of Raw Yarns]

Process A

A yarn was spun, using polyethylene terephthalate of an intrinsic viscosity of 0.62, at an extrusion rate of 23.0 g/min and a spinning temperature of 290° C. through a spinneret having 24 spinning nozzles, each having an extrusion diameter of 0.3 mm and a length of 0.6 mm, and taken up at a winding speed of 1350 m/min. The obtained undrawn yarn was subjected to pin-drawing at a draw ratio of 3.06, a drawing speed of 500 m/min and a pin temperature of 100° C. and then subjected to a heat treatment with a hot plate. The heat treatment temperature adopted was 0°, 150° or 200° C.

Process B

Polyethylene terephthalate of an intrinsic viscosity of 0.62 was melt spun at an extrusion rate of 33.3 g/min and a spinning temperature of 290° C. by using an apparatus as shown in FIG. 3, which had a spinneret having 24 nozzles, each having an extrusion diameter of 0.3 mm and a length of 0.6 mm. The winding speed was set at 6000 m/min, and the stretch treatment was effected between the first and second goddet rolls at stretch ratio as shown in Table 1.

[Weaving Conditions]

Warp: 50 denier/24 filaments
Weft: 50 denier/24 filaments
Warp density: 103 yarns per inch
Weft density: 95 yarns per inch
Grey fabric: 96.0 cm(width)×22 cm(length)

TABLE 1

| Run No. | Preparation Process | Heat Treatment Temperature (°C.) | Stretch Ratio (%) | Properties of Yarns: Residual Elongation (%) | Young's Modulus (g/d) | ΔSw (%) | ΔSd (%) | Tpeak (°C.) |
|---|---|---|---|---|---|---|---|---|
| 1 | A | 0 | — | 35 | 125 | 13.0 | 17.5 | 105 |
| 2 | A | 150 | — | 37 | 123 | 6.9 | 10.0 | 152 |
| 3 | A | 200 | — | 38 | 121 | 4.3 | 6.4 | 198 |
| 4 | B | — | 0 | 51 | 75 | 3.6 | 4.2 | 89 |
| 5 | B | — | 8 | 54 | 73 | 4.7 | 5.6 | 87 |
| 6 | B | — | 20 | 53 | 72 | 8.1 | 9.5 | 89 |
| 7 | B | — | 30 | 45 | 70 | 80.0 | 9.8 | 88 |

Yarns of runs Nos. 1, 2 and 3 were those obtained according to the conventional processes, the yarn of run No. 4 was a super-high speed spun yarn, and yarns of runs Nos. 5, 6 and 7 were yarns prepared according to the novel processes. The yarns of runs Nos. 5 and 6 were raw yarns according to the present invention.

Incidentally, in Table 1, ΔSw means the boiling water shrinkage, ΔSd means the dry heat shrinkage, and Tpeak means the stress peak temperature in the dry heat shrinkage stress curve.

TABLE 2

| Run No. | Raw Yarn Preparation State | Weaving Test State | Evaluation of Hand |
|---|---|---|---|
| 1 | stable | weaving difficult because of too large ΔSw | — |
| 2 | stable | good | prominent coarse and stiff hand |
| 3 | violent white smoke at heat treatment | good | coarse and stiff hand |
| 4 | unstable, single yarn breakage | fluff formed | kink unevenness |
| 5 | stable | good | soft, high stiffness, good hand |
| 6 | stable | good | soft, high stiffness, good hand |
| 7 | stable | weaving difficult because of too large ΔSw | — |

In runs Nos. 5 and 6 according to the present invention, the raw yarn preparation state was very good, and the weaving test results were very good and woven fabrics with an excellent hand were obtained.

EXAMPLE 2

The raw yarns obtained in runs Nos. 1 through 7 of Example 1 were highly twisted at a twist number of 3000 twists per meter, and they were subjected to a twist-setting treatment. The twist-setting temperature necessary for controlling the torque after setting of twists to a level not causing any problems at subsequent processing steps was measured to obtain the results shown in Table 3.

TABLE 3

| Run No. | Twist Setting Temperature (°C.) |
|---|---|
| 1 | 85 |
| 2 | 90 |
| 3 | 94 |
| 4 | 45 |
| 5 | 50 |
| 6 | 50 |
| 7 | measurement impossible because of too large ΔSw |

In the raw yarns having a Tpeak value smaller than 100° C. in Table 1, the temperature necessary for setting twists is very low, and it is seen that these raw yarns are excellent in heat setting efficiency.

EXAMPLE 3

Polyethylene terephthalate of an intrinsic viscosity of 0.62 was melt spun at an extrusion rate of 33.3 g/min and a spinning temperature of 290° C. using an apparatus as shown in FIG. 3, which had a spinneret provided with 24 spinning nozzles each having a diameter of 0.3 mm and a length of 0.6 mm. The winding speed was set at 6,000 m/min, and the stretch treatment was carried out between the first and second goddet rolls at various stretch ratios as shown in Table 4. The peripheral speed of the second goddet roll was maintained at 5,977 m/min to set the winding tension to a constant level of 0.3 g/d, and thus, the stretch ratio was varied by changing the peripheral speed of the first goddet roll.

The obtained yarns were woven under the following conditions.

Warp: 50 denier/24 filaments
Weft: 50 denier/24 filaments
Warp density: 103 yarns per inch
Weft density: 95 yarns per inch
Grey fabric: 96.0 cm(width)×22 cm(length)

The spinning states, the physical properties of the obtained yarns and the organoleptic hand test results of the woven fabrics are shown in Table 4.

TABLE 4

| Run No. | Speed of First Goddet Roll (m/min) | Stretch Ratio (%) | Properties of Yarns: Strength (g/d) | Elongation (%) | ΔSw (%) | Spinning States: Tension Fluctuation before First Goddet Roll (%) | Fluctuation in Winding Tension (%) | Yarn Breakage | Hand of Woven Fabric |
|---|---|---|---|---|---|---|---|---|---|
| 8 | 5,977 | 0 | 4.1 | 51 | 3.6 | 13.5 | 44.4 | sometimes occurs | good |
| 9 | 5,860 | 2 | 4.1 | 52 | 3.8 | 7.5 | 23.0 | does not occur | good |
| 10 | 5,747 | 4 | 4.1 | 53 | 4.1 | 5.6 | 20.5 | does not occur | good |
| 11 | 5,534 | 8 | 4.2 | 54 | 4.7 | 5.3 | 20.8 | does not occur | good |
| 12 | 5,337 | 12 | 4.1 | 54 | 5.0 | 5.2 | 21.0 | does not occur | good |
| 13 | 5,152 | 16 | 4.2 | 54 | 6.5 | 5.0 | 16.4 | does not occur | good |
| 14 | 4,980 | 20 | 4.2 | 53 | 8.1 | 5.8 | 13.0 | does not occur | good |
| 15 | 4,899 | 22 | 4.2 | 48 | 10.4 | 5.4 | 13.1 | sometimes occurs | creping defect |
| 16 | 4,782 | 25 | 4.2 | 47 | 13.4 | 5.3 | 13.5 | occurs | creping defect |
| 17 | 4,598 | 30 | 4.3 | 45 | 80.0 | 5.6 | 13.0 | occurs | creping defect |

Run No. 8 is a comparative example in which the stretch ratio is 0%, i.e. the yarn is not stretched. In this case, the yarn vibration between the first and second goddet rolls and thus the tension fluctuation in this region were large, and the fluctuation in the winding tension was too large. In Runs Nos. 15 to 17, component filament breakage occurred, and since the boiling water shrinkage was too high, creping defect appeared on the woven fabric and the hand and appearance of the fabric were inferior. In Runs Nos. 9 to 14 according to the present invention, the spinning was carried out stably and the woven fabric has a good hand.

The tension fluctuation was calculated by the following equation:

$$\text{Tension fluctuation}(\%) = \frac{\text{Amplitude of fluctuation}}{\text{Mean value}} \times 100$$

EXAMPLE 4

The procedure used in Example 3 was repeated, except that the stretch ratio was 12%, the winding tension was 0.3 g/d, and the winding speed was varied within a range of 2,000 m/min to 8,000 m/min.

The spinning states and the properties of the yarns are shown in Table 5.

TABLE 5

| Run No. | Winding Speed (m/min) | Properties of Yarns: Strength (g/d) | Elongation (%) | ΔSw (%) | Yarn Unevenness (U %) | Spinning States |
|---|---|---|---|---|---|---|
| 18 | 2,000 | 2.0 | 260 | 65 | not less than 10 very bad | component filament breakage often occurs, spinning and winding tensions are large, fluctuations in spinning and winding tensions are large |
| 19 | 3,000 | 2.6 | 180 | 62 | 0.9 to 1.1 fairly good | |
| 20 | 4,000 | 3.3 | 100 | 60 | 0.9 to 1.1 fairly good | component filament breakage often occurs, spinning and winding tensions are large, fluctuations in spinning and winding tensions |

TABLE 5-continued

| Run No. | Winding Speed (m/min) | Properties of Yarns Strength (g/d) | Elongation (%) | ΔSw (%) | Yarn Unevenness (U %) | Spinning States |
|---|---|---|---|---|---|---|
| | | | | | | are large |
| 21 | 5,000 | 3.8 | 62 | 5.3 | 0.6 to 0.7 | spinning is fairly stable |
| 22 | 5,500 | 3.9 | 60 | 5.0 | 0.3 to 0.6 very good | spinning is stable |
| 23 | 6,000 | 4.1 | 54 | 4.8 | 0.3 to 0.6 very good | spinning is stable |
| 24 | 7,000 | 4.2 | 46 | 4.8 | 0.3 to 0.6 very good | spinning is stable |
| 25 | 8,000 | 4.3 | 40 | 4.7 | 0.3 to 0.6 very good | spinning is stable |

As is clearly seen from Table 5, the yarns obtains in Runs Nos. 18 to 20 were very inferior in physical properties and their spinning states were bad. In Run No. 21 in which the winding speed reached 5,000 m/min, it became possible to carry out the spinning fairly stably. In Runs Nos. 22 to 25 in which the winding speed was not lower than 5,500 m/min, the spinning could be carried out stably and the obtained yarns had satisfactory physical properties.

EXAMPLE 5

The procedure used in Run. No. 5 of Example 1 was repeated, except that the spinning temperature and the intrinsic viscosity $\eta$ and moisture regain of the feeding chips were varied as shown in Table 6. The measured small angle X-ray scattering pattern and $\Delta\nu$ of each of the obtained yarns as well as the spinning states are shown in Table 7.

TABLE 6

| Run No. | Intrinsic Viscosity[$\eta$] | Moisture Regain (%) | Spinning Temperature (°C.) |
|---|---|---|---|
| 26 | 0.62 | 0.015 | 310 |
| 27 | 0.64 | 0.010 | 310 |
| 28 | 0.64 | 0.010 | 305 |
| 29 | 0.66 | 0.010 | 300 |
| 30 | 0.66 | 0.007 | 295 |
| 31 | 0.70 | 0.007 | 295 |

TABLE 7

| Run No. | Small Angle Pattern | Δν | Spinning States | Yarn Breakage (times/ton) |
|---|---|---|---|---|
| 26 | as shown in FIG. 1 | 1.4 | very good | 0.3 |
| 27 | as shown in FIG. 1 | 2.0 | very good | 0.6 |
| 28 | as shown in FIG. 1 | 2.8 | very good | 0.4 |
| 29 | as shown in FIG. 1 | 3.0 | good | 0.8 |
| 30 | as shown in FIG. 1 | 3.4 | fairly bad | 1.5 |
| 31 | as shown in FIG. 1 | 3.8 | fairly bad | 2.0 |

In Runs Nos. 26 to 31, raw yarns suitable for producing woven and knitted fabrics were obtained. In particular, in Runs Nos. 26 to 29 in which $\Delta\nu$ was not more than 3.0, yarn breakage occured very rarely and the spinning could be carried out very stably.

We claim:

1. A polyester fiber having a residual elongation of not higher than 60%, a Young's modulus of 60 to 100 g/d, a boiling water shrinkage of 4 to 10% and a dry heat shrinkage of 5 to 12%, the peak stress temperature in a dry heat shrinkage stress curve of said fiber being lower than 100° C.

2. A fiber as claimed in claim 1, wherein the polyester contains not less than 80 mole % of ethylene terephthalate units.

3. A fiber as claimed in claim 1, which shows a specific diagonal four-point interference pattern in the small angle X-ray scattering pattern.

4. A fiber as claimed in any one of the preceding claims 1 to 3, wherein the difference $\Delta\nu$ between the maximum half-band width and the minimum half-band width in the Raman spectra at 1730 $cm^{-1}$ scattered at radial individual points of the fiber cross-section by laser beam focussed on the points is not more than 3 $cm^{-1}$.

* * * * *

UNITED STATES PATENT AND TRADEMARK OFFICE

CERTIFICATE OF CORRECTION

PATENT NO. : 4,390,685

DATED : June 28, 1983

INVENTOR(S) : Ken-ichiro Oka et al.

It is certified that error appears in the above-identified patent and that said Letters Patent is hereby corrected as shown below:

In the (Letters Patent) only, columns 3 and 4 should appear as shown on the attached sheet.

Signed and Sealed this

*Thirty-first* Day of *July 1984*

[SEAL]

*Attest:*

GERALD J. MOSSINGHOFF

*Attesting Officer*

*Commissioner of Patents and Trademarks*

Thus, the present invention provides a polyester fiber having a residual elongation of not higher than 60%, a Young's modulus of 60 to 100 g/d, a boiling water shrinkage of 4 to 10% and a dry heat shrinkage of 5 to 12%, the peak stress temperature in a dry heat shrinkage stress curve of said fiber being lower than 100° C. The polyester fiber according to the present invention preferably shows a specific diagonal four-point interference pattern in the small angle X-ray scattering pattern. Further, in the polyester fiber of the present invention, the difference, $\Delta\nu$, between the maximum half-band width and the minimum half-band width in the Raman spectra at 1730 $cm^{-1}$ scattered at radial individual points of the fiber cross-section by laser beam focussed on the points is preferably not more than 3 $cm^{-1}$.

The present invention will be described in detail below.

Polyester suitable for use in the present invention preferably contains not less than 80 mole %, more preferably 90 mole %, of ethylene terephthalate units. It may be a copolymer but the copolymer should preferably contain at least 80 mole %, more preferably at least 90 mole %, of ethylene terephthalate units.

In order for the fiber to have physical properties which permit efficient further processing, it is necessary that the residual elongation of the fiber should be lower than 60% and preferably higher than 30%. If the residual elongation is higher than 60%, the structure of the raw yarn is unstable and is remarkably changed with the lapse of time, and deformation is readily caused under application of a slight external force. Accordingly, such raw yarn cannot practically be used as a raw yarn for a woven or knitted fabric. The Young's modulus should be in the range of from 60 to 100 g/d and preferably in the range of from 70 to 90 g/d. In ordinary polyester fibers, the Young's modulus is about 120 g/d. If the Young's modulus is adjusted to the relatively low level described above, the coarse and stiff hand can be eliminated from the resulting woven or knitted fabric, and good bulkiness and softness can be imparted to the woven or knitted fabric. When the Young's modulus is lower than 60 g/d, the resulting woven or knitted fabric is too soft and has very low stiffness and the fabric is an undesirable paper-like product.

In the present invention, it is important that the boiling water shrinkage be controlled to 4 to 10% and preferably 5 to 8% and the dry heat skrinkage be controlled to 5 to 12% and preferably 6 to 10%. A raw yarn having a boiling water shrinkage lower than 4% or a dry heat shrinkage lower than 5% is defective in that the elasticity is very low, a great change in tension is caused by a slight change of the winding relax ratio or the like and the structure of the yarn is readily made uneven in the lengthwise direction of the yarn. In an extreme case, the yarn cannot be wound in a uniform or stable package and problems such as formation of fluff and component filament breakage occur, rendering the operation practically impossible. For example, even if a package is formed from such raw yarn, fluff and other defects are readily formed on the yarn by large tensile forces or squeezing forces applied to the yarn at various subsequent processing steps in the manufacture of a woven or knitted fabric. Occurrence of these problems can be prevented by controlling the shrinkage characteristics of the raw yarn within the above-mentioned ranges. When the boiling water shrinkage or dry heat shrinkage exceeds the upper limit, a woven or knitted fabric cannot be prepared from the raw yarn, since tentering at the finishing step is difficult to carry out successfully or the resulting fabric is an undesirable paper-like product because the rate of shrinkage is too high.

The most characteristic feature of the fiber of the present invention as a raw yarn for a woven or knitted fabric is that although the fiber has the above-mentioned residual elongation, Young's modulus and shrinkage characteristics, the peak stress temperature in a dry heat shrinkage stress curve is lower than 100° C.

In the case where this peak stress temperature is lower than 100° C, the heat set efficiency can be markedly increased by various heat set treatments at subsequent processing steps for the manufacture of a woven or knitted fabric.

As will be apparent from the foregoing description, if all of the above requirements of the residual elongation, Young's modulus, shrinkage characteristics and peak stress temperature specified in the present invention are simultaneously satisfied, a polyester fiber can be wound in a stable and uniform package as a raw yarn for woven or knitted fabric, and this polyester fiber shows a very good heat setting properties at subsequent processing steps and a desirable feel and touch is imparted to a woven or knitted fabric prepared from this raw yarn.

Figure 2:
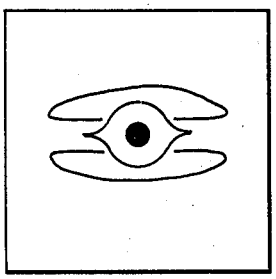
FIG. 2 shows a small angle X-ray scattering pattern of a conventional drawn polyester fiber.

The present invention will further be illustrated below with reference to the attached drawings, wherein:

FIG. 1 shows a diagonal four-point interference pattern in the small angle X-ray scattering pattern of a preferred embodiment of the polyester fiber of the present invention;

FIG. 2 shows a small angle X-ray scattering pattern of a conventional drawn polyester fiber;

FIG. 3 shows a schematic view of an apparatus on which the process for producing the polyester fiber according to the invention can be advantageously carried out; and, FIG. 4 shows a pattern of a scattered Raman spectrum.

The polyester fiber of the present invention preferably has a specific diagonal four-point interference pattern, in the small angle X-ray scattering pattern, as shown in Fig. 1. The small angle X-ray scattering pattern shown in FIG. 2 clearly differs from the pattern in FIG. 1 and is of a practically usable, conventional drawn polyester fiber obtained by taking up a spun yarn at a speed of 1,000 to 1,500 m/min and heat drawing the yarn.

It is supposed that the specific diagonal four-point interference pattern as shown in FIG. 1 represents the fact that the crystallization of the fiber does not proceed by the action of heat. That is, during the cooling of the as spun polymer, the crystallization of the polymer and thus the orientation may rapidly proceed, by the internal stress through the elongation during the spinning, at a temperature range affording high crystallization rate and, at the same time, the relaxation of orientation in the amorphous region may proceed. Therefore, the resulting fiber has an internal structure similar to that of a crystalline fiber affording desirable physical properties sufficient for practical use, while the fiber also has very excellent heat setting ability since the crystalline structure is not formed by heat crystallization.

Further, the polyester fiber according to the present invention preferably has a distribution of crystallinity in the radius direction controlled to a constant level. A means for precisely determining the distribution of crys-